US005348105A

United States Patent [19]

Lappalainen et al.

[11] Patent Number: 5,348,105

[45] Date of Patent: Sep. 20, 1994

[54] METHOD FOR ALIGNING A FEEDING BEAM IN A ROCK DRILLING EQUIPMENT AND A ROCK DRILLING EQUIPMENT AND A MEASURING DEVICE

[75] Inventors: Juhani Lappalainen; Heikki Rinnemaa; Ari Tuunanen, all of Tampere; Pertti Saarelainen, Lieksa, all of Finland

[73] Assignee: Tamrock Oy, Tampere, Finland

[21] Appl. No.: 50,248

[22] Filed: May 7, 1993

[30] Foreign Application Priority Data

Nov. 30, 1990 [FI] Finland ..... 905920

[51] Int. Cl.[5] ..... E21B 7/00

[52] U.S. Cl. ..... 175/24

[58] Field of Search ..... 175/24, 40, 52, 85

[56] References Cited

U.S. PATENT DOCUMENTS

| | | | |
|---|---|---|---|
| 4,022,284 | 5/1977 | Crow | 175/24 X |
| 4,343,367 | 8/1982 | Mashimo . | |
| 4,604,724 | 8/1986 | Shaginian et al. | 175/24 X |

FOREIGN PATENT DOCUMENTS

| | | |
|---|---|---|
| 0011056 | 5/1980 | European Pat. Off. . |
| 74113 | 10/1979 | Finland . |
| 3509/71 | 8/1983 | Finland . |
| 133242 | 12/1971 | Norway . |
| WO80/01202 | 6/1980 | PCT Int'l Appl. . |
| 349350 | 9/1972 | Sweden . |
| 358204 | 7/1973 | Sweden . |
| 381912 | 8/1974 | Sweden . |

*Primary Examiner*—Thuy M. Bui
*Attorney, Agent, or Firm*—Nixon & Vanderhye

[57] ABSTRACT

A method, a rock drilling equipment (1) a measuring device (10) for aligning a feeding beam (5) in the rock drilling equipment (1) with a drilling direction. In the method, an angle Sg(g) between the drilling direction ($S_p$) and a direction ($S_t$) defined by a fixed point selected as a point of sight (T) is measured and stored in a memory, and the feeding beam (5) is adjusted at the following holes so that it is positioned at an angle $\beta$ corresponding to the drilling direction ($S_p$) measured with respect to a direction ($S_a$) of a carrier (1*a*) by means of the point of sight (T). The measuring device (10) comprises two mutually turntable discs (11, 12) of which one is positioned to indicate the drilling direction ($S_p$) and the other is turned in such a way that its measuring line points towards a fixed point serving as a point of sight (T), thus defining a reference line ($S_t$).

13 Claims, 2 Drawing Sheets

Figure 1:
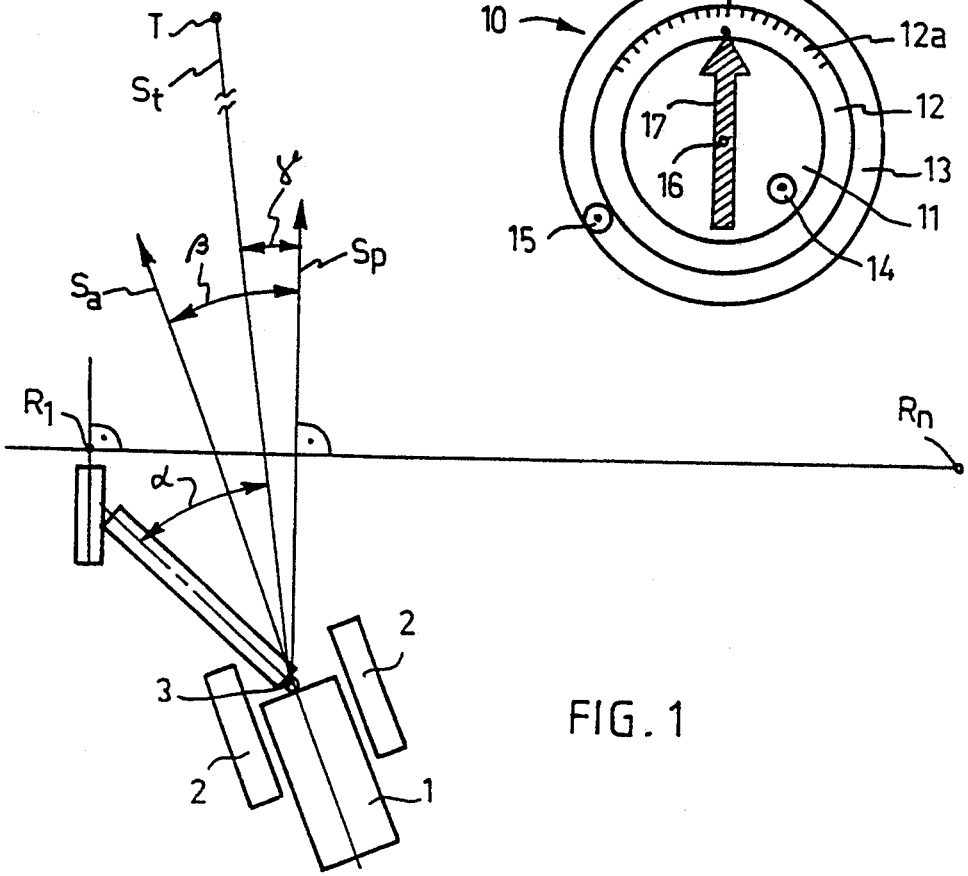

METHOD FOR ALIGNING A FEEDING BEAM IN A ROCK DRILLING EQUIPMENT AND A ROCK DRILLING EQUIPMENT AND A MEASURING DEVICE

The invention relates to a method for aligning a feeding beam which is attached to the end of a boom turnable with respect to a carrier of a rock drilling equipment and which is turnable with respect to the boom when drilling holes in a rock on the surface of the earth substantially in line and in the same plane, wherein an angle between a longitudinal direction of the rock drilling equipment and a drilling direction is determined, and the feeding beam is aligned with the drilling direction in parallel with the plane by turning the boom with respect to the carrier and the feeding beam with respect to the end of the boom in such a way that the turning angles of the feeding beam with respect to the boom are determined on the basis of an angle between the boom and the longitudinal direction of the carrier and an angle between the longitudinal direction of the carrier and the drilling direction.

The invention is also concerned with a rock drilling equipment for realizing a method according to claim 1, comprising a carrier; a boom mounted in the carrier turnably with respect to it; a feeding beam mounted turnably in two planes at an angle with respect to each other with respect to the boom; control means for turning the boom and the feeding beam; measuring means for measuring an angle between the longitudinal direction of the carrier and the boom, for measuring the direction of the feeding beam with respect to the boom, and for measuring an angle between the longitudinal direction of the carrier and a drilling direction; and calculating means for calculating set values for aligning the feeding beam on the basis of the measured angles.

The invention further concerns a measuring device for aligning a feeding beam in a rock drilling equipment in accordance with a method according to claim 1, the measuring device comprising a body part arranged to be positioned at least in a longitudinal direction of a carrier of the rock drilling equipment and an aligning means turnable with respect to the body part, the aligning means being arranged to be positioned in the drilling direction for determining an angle between the longitudinal direction of the carrier and the drilling direction.

In excavation, drilling is usually performed by drilling holes side by side in a vertical or slanting plane perpendicular to the direction of excavation, and the holes are then charged and blasting is carried out to extract rock. In order to ensure that the excavation takes place in a desired manner, the drill holes have to be positioned sufficiently accurately in the excavation plane in question and in parallel with it as the excavation is designed to be performed in a predetermined order. Control and measuring devices are used to position the drilling machine of the rock drilling equipment in a desired direction with a desired inclination. Such devices indicate the angle of inclination of the feeding beam of the drilling machine in two planes perpendicular to each other. For example, the angle can be indicated in a plane extending in the longitudinal direction of the boom and in a vertical plane transverse to the end of the boom, whereby the feeding beam can be positioned at a desired angle with respect to the carrier of the rock drilling equipment. For the drilling process, the directional angles of the feeding beam and thus those of the drill rod are calculated and determined as inclinations in the drilling direction, that is, as the inclination of the drilling plane and, on the other hand, as an inclination in the drilling plane. This as such is inconvenient and complicated, but there are aligning devices developed for indicating the direction of the feeding beam and thus that of the drill rod in a desired manner with respect to the carrier of the drilling equipment. Consequently, the direction of the carrier with respect to the drilling plane has to be known in order to align the drill rod appropriately with respect to the drilling plane. For excavation, an equipment disclosed in FI Patent Application 3509/71 is used, which comprises a sighting means the turning angle of which is provided with sensors. The sighting means is positioned in the direction of excavation when aligning the feeding beam, and so it calculates, by means of a calculator provided in it, the angles of inclination of the feeding beam with respect to the carrier, and thus also with respect to the drilling direction, on the basis of the turning angle of the sighting means with respect to the longitudinal direction of the carrier, the turning angle of the boom and the information provided by inclination sensors provided in the feeding apparatus. If the device allows presetting of angles, it also indicates at the same time in which direction the boom and the feeding beam should be turned in order that it would be positioned in the drilling direction, that is, in the reference direction perpendicular to the drilling plane, and appropriately inclined.

A disadvantage of such means is that the point of sight must always be positioned in the drilling direction, that is, perpendicular to the excavation plane defined by the holes to be drilled, in order for the equipment to be operative. This means that because there is in many cases no clear landmark at a sufficient distance in the direction of excavation, the point of sight has to be erected separately. Moreover, no other direction than the drilling direction can be used as the reference direction. The means is also complicated and expensive and difficult to use.

The object of the present invention is to provide a method and an equipment for aligning a drilling process, which avoid the above-mentioned disadvantages and which are simple and easy to use. A method according to the invention is characterized in that it utilizes a reference direction determinable in every drilling position of the carrier in the alignment, that an angle between the reference direction and the drilling direction is determined, that the drilling direction is determined at least after the first drilling position of the drilling equipment on the basis of the reference direction and the angle, that the angle between the longitudinal direction of the carrier and the drilling direction is determined on the basis of the drilling direction so determined, and that the feeding beam is aligned on the basis of the angle so determined so that it is parallel with the drilling direction and the drilling plane.

A drilling equipment according to the invention is characterized in that it comprises an indicating means for indicating an angle between a reference direction and the drilling direction, and that the calculating means is arranged to calculate the set values for the feeding beam on the basis of the angle.

A measuring device according to the invention is characterized in that it comprises reference means for defining a reference direction and for determining an angle between said reference direction and the drilling direction.

The basic idea of the invention is that one selects a clearly visible landmark or other similar point of sight at a distance, and an angle between the drilling direction and a direction between the point of sight and the carrier, i.e. a reference direction is measured. This angle is stored in a memory, and then, when the carrier has been displaced into a new drilling position, one only has to turn the sight towards the point of sight, that is, in the reference direction, and the feeding beam is turned so that it is at the angle stored in the memory with respect to the reference direction, and inclined so that it has the desired inclination in the plane of excavation. Advantages of the method and the equipment according to the invention are that they are simple, reliable, easy to use and economical.

Figure 2:
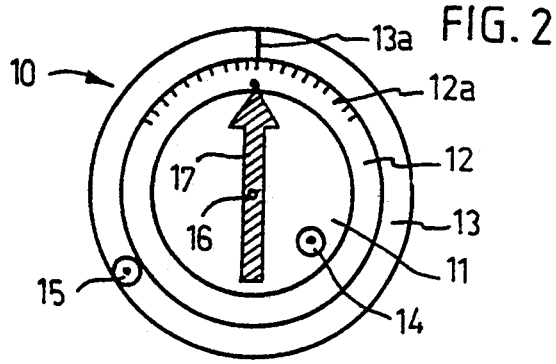
Figure 3A:
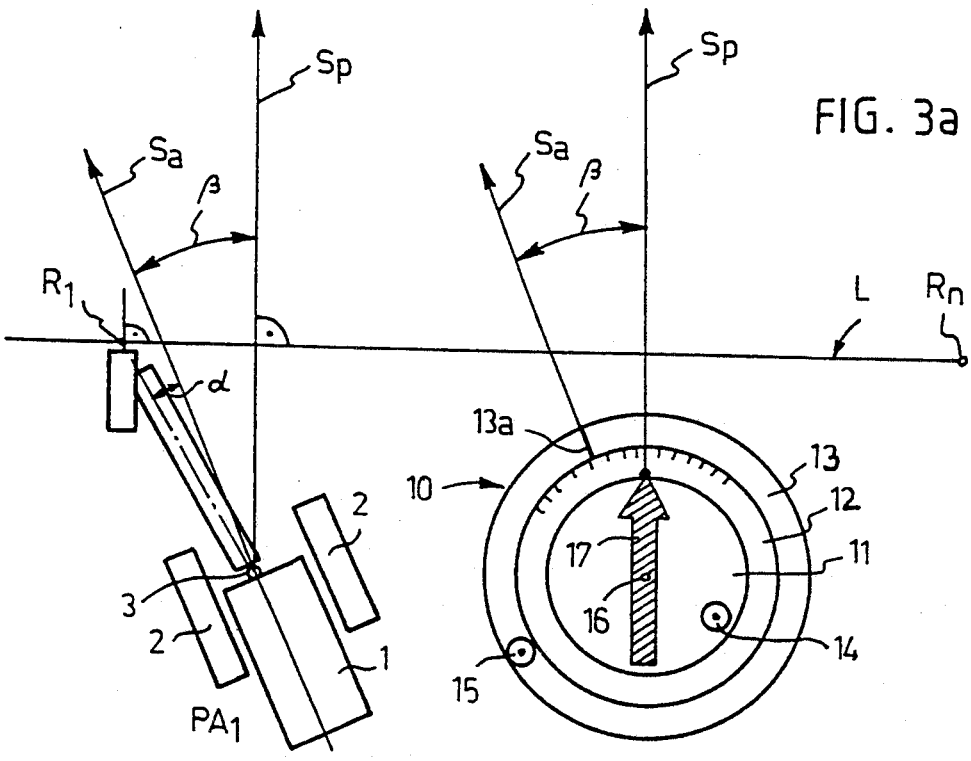
Figure 3B:
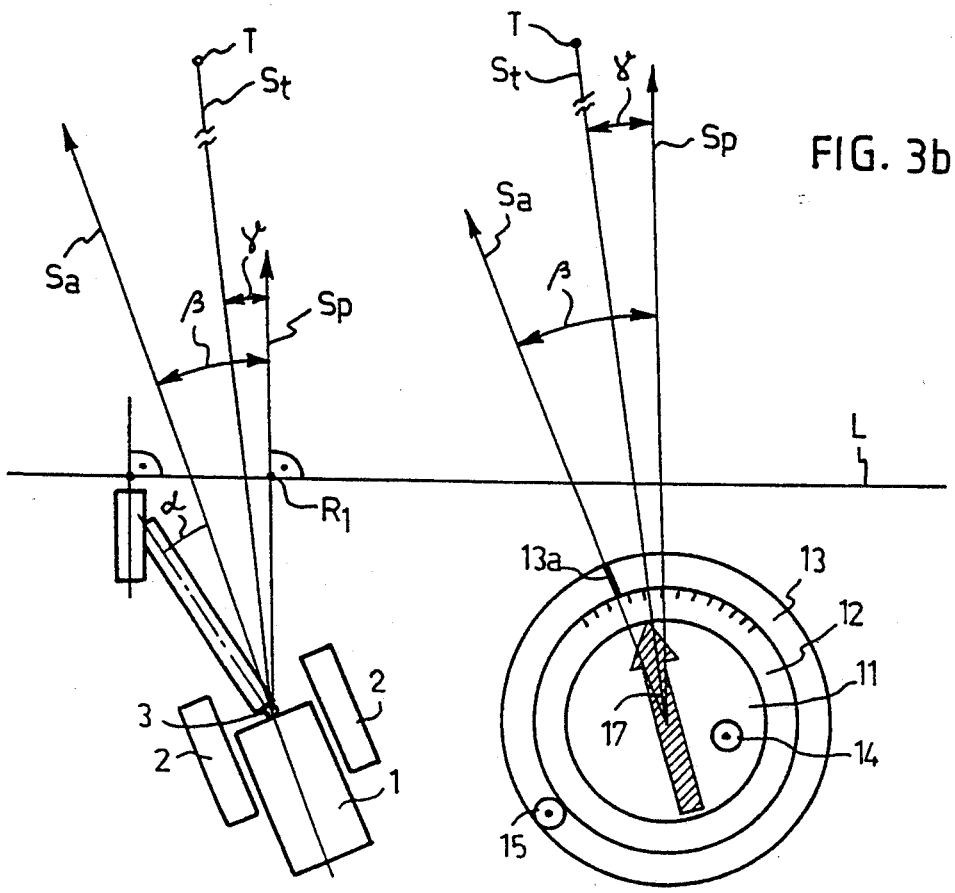
Figure 3C:
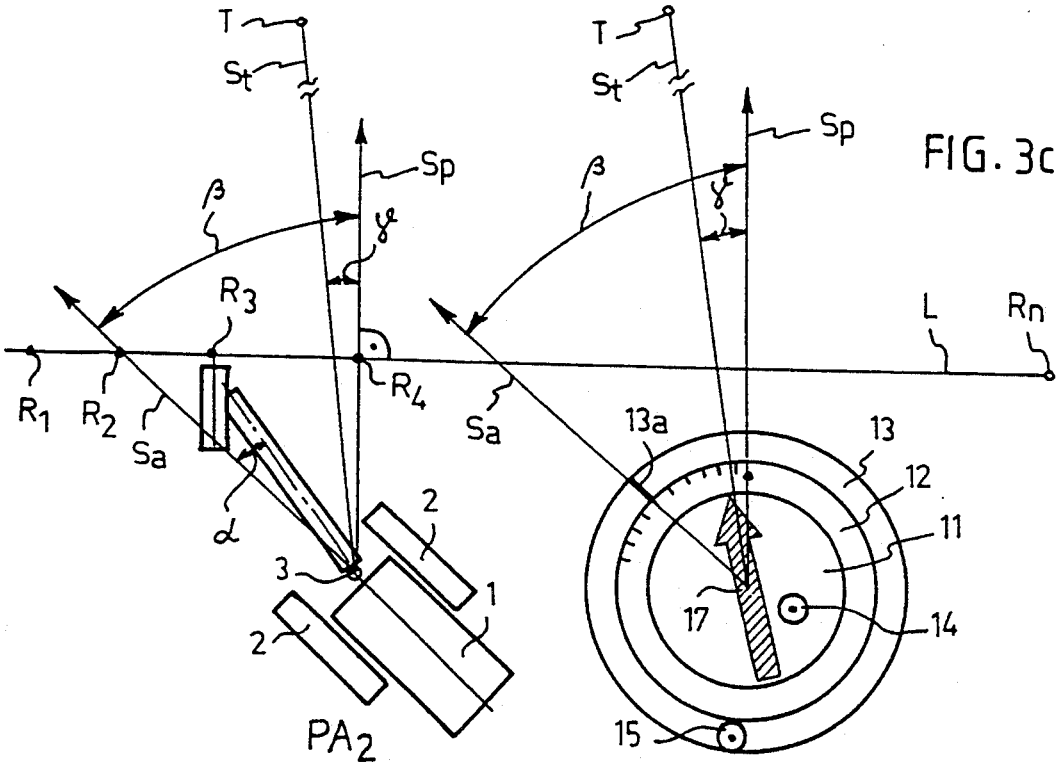

The invention will be described in greater detail in the attached drawings, in which FIG. 1 illustrates schematically the alignment of a rock drilling equipment in accordance with a field to be drilled;

FIG. 2 illustrates schematically a measuring device according to the invention; and FIGS. 3*a* to 3*c* illustrate the use of the measuring device of FIG. 2 in accordance with the invention.

In FIG. 1, a rock drilling equipment 1 is positioned at an excavation site so as to drill a row of holes in line with an excavation plane L. The rock drilling equipment 1 usually comprises a carrier moving on crawler tracks 2, to which carrier a drill boom 4 is mounted turnably about a vertical shaft 3 with respect to the carrier. At the end of the drill boom there is provided a feeding beam 5 for a drilling machine, which feeding beam is vertically turnable with respect to the boom 4 about a shaft. A rock drilling equipment of this type is known per se e.g. from FI Patent Application 3509/71, and will not be described more closely. To turn the boom with respect to the carrier, the boom comprises actuating means and means for controlling them, and a measuring device for indicating an angle $\alpha$ between the boom 4 and the carrier 1*a* so as to indicate the direction of the feeding beam 5 with respect to the boom 4, and an associated display device. These are also known per se e.g. from the FI Patent Application 3509/71 mentioned above, and will not be described in more detail. The carrier is positioned at the drilling site in a predetermined longitudinal direction indicated by a line $S_a$ in FIG. 1. A drilling direction $S_p$, in turn, is perpendicular to the excavation plane L. An angle $\beta$ between the direction $S_a$ of the carrier and the drilling direction $S_p$ represents the deviation of the carrier 1*a* from the drilling direction $S_p$. This means that, for drilling, the boom 4 has to be turned with respect to the carrier 1*a* and the feeding beam 5 has to be turned with respect to the boom 4 in such a way that the hole will be drilled at a desired point and in the right direction. In the most advantageous case, of course, the boom 4 would be positioned in parallel with the drilling direction $S_p$, and so the feeding beam 5 could be inclined in this direction only in such a way that the hole would be drilled in line with the excavation plane L. In practice, however, several holes are drilled from the same position of the carrier, and thus the boom 4 has to be turned with respect to the carrier 1*a* into a different position for each specific hole and, correspondingly, the feeding beam 5 has to be turned into different angles with respect to the boom 4 at each hole in order that the holes would be positioned in line with each other appropriately in the excavation plane L. In order to accurately determine the direction of the feeding beam 5 and thus that of the drill rod, the sensors measuring the direction and position of the feeding beam 5 and the sensors measuring the direction and geometry of the boom 4 are interconnected in a manner known per se in such a way that the sensors and indicators are connected to a calculating device which calculates the direction of the feeding beam 5 on the basis of the information provided by the sensors and indicators and the geometry of the boom and the joints either with respect to the carrier 1*a* or with respect to the surface of the earth, depending on the used sensors. When the angle $\beta$ between the longitudinal direction $S_a$ of the carrier 1*a* and the drilling direction $S_p$, and the angle $\gamma$ between a reference direction $S_t$ and the drilling direction $S_p$ are known, the drilling equipment can be aligned appropriately for drilling holes simply and easily in accordance with the invention.

FIG. 1 further shows a point of sight T needed as an aligning mark when applying the invention. The point of sight T is a fixed point positioned at a distance from the excavation plane L in the direction $S_t$, such as a stationary landmark or other similar object immovable at least during the drilling process. When the point of sight is positioned in a direction clearly transverse to the excavation plane, the distance from the excavation plane L to the point of sight T is at least ten times the distance between the outermost holes $R_1$ and $R_n$ in a row of holes to be drilled at a time.

The angle $\gamma$ between the drilling direction $S_p$ and the reference direction $S_t$, that is, the direction from the carrier to the point of sight T is essential to the application of the invention and indicates the difference between the two directions.

FIG. 2 shows schematically a measuring device suitable for applying the invention. The measuring device comprises a sighting means, that is, a sighting disc 11, an aligning means, that is, an aligning disc 12, and a body part 13. The aligning disc 12 is provided with a scale 12*a* which indicates the angle between the aligning disc 12 and the body part 13, that is, the angle $\beta$ between the longitudinal direction $S_a$ of the carrier and the drilling direction $S_p$. The body part 13, which is mounted unturnably with respect to the carrier, is provided with a measuring line 13*a* which indicates the direction $S_a$ of the carrier for the measuring purposes. The discs 11 and 12 can be turned both with respect to the body part 13 and with respect to each other. However, the discs 11 and 12 can be interlocked by means of a locking nut 14 in such a way that they turn simultaneously. For the time of setting the values, it is possible to lock the disc 12 to the disc 13 by means of another locking nut 15. The locking nuts may be of any known structure by means of which two parts movable or slidable with respect to each other can be locked to each other, if required. These are known per se and will thus not be described in more detail. The discs 11 and 12 turn about a shaft 16. The sighting disc 11 preferably comprises line sights or loop sights for setting the line of sight of the disc so that it points towards the point of sight T positioned at a distance. In this measuring device, the sighting disc 11, the aligning disc 12, the scale 12*a* and the measuring line 13*a* constitute the reference means. In other embodiments of the measuring device, the reference means, of course, may be different and separate parts.

FIG. 3*a* shows a situation in which the rock drilling equipment is positioned at the excavation site in a first drilling position $PA_1$ and is ready to drill a first hole $R_1$. The excavation plane L is defined e.g. by indicating a line between the first and the last hole. For drilling the feeding beam 5 has to be aligned so that it is perpendicular to the line $R_1$–$R_n$, that is, perpendicular to the entire row of holes of the excavation plane, and in parallel with the desired drilling direction $S_p$, in addition to which is has to be inclined through a suitable angle. For this purpose, the discs 11 and 12 of the sighting device 10 are turned at the first hole e.g. in such a way that the line of sight of the sighting disc 11 and the zero position of the aligning disc 12 indicate the drilling direction as shown in FIG. 3*a*, whereby the drilling direction can be determined in any conventional manner. Thereafter the aligning disc 12 is locked immovable with respect to the body part 13 and the sighting disc 11 is released from the locking with the aligning disc 12. The sighting disc 11 is then turned as shown in FIG. 3*b* in such a way that its line of sight or reference direction $S_t$ indicated by the arrow 17 extends through a suitable fixed point T at a distance, such as e.g. a landmark or some other object immovable during the drilling process. The angle $\gamma$ so obtained between the drilling direction $S_p$ and the reference direction $S_t$ is stored in a memory by interlocking the discs 11 and 12 with each other. The boom 4 is positioned at a suitable angle $\alpha$ and the feeding beam 5 is turned with respect to the end of the boom, and the calculating device calculates the actual direction and inclination of the feeding beam and thus also those of the drill rod on the basis of the turning angle $\alpha$ of the boom 4 and the turning angles of the feeding beam 5. The first hole can be drilled when the longitudinal direction of the feeding beam 5, that is, the longitudinal direction of the drill rod, coincides with the drilling direction, and the inclination of the feeding beam 5 in this direction is the same as that of the planned drilling plane L. Thereafter the boom 4 is turned to a second hole $R_2$ and the feeding beam 5 and thus the drill rod are turned so as to extend in the drilling direction $S_p$ and to have an appropriate inclination as described above and as is known per se. After the drilling of the first series of drill holes, that is, holes which can be drilled in the same drilling position $PA_1$ of the carrier, the carrier is displaced to the next drilling position $PA_2$, and the feeding beam is again aligned with the drilling direction. This takes place in the second position $PA_2$ and in all the following positions by directing the line of sight 17 of the sighting disc 11 towards the point of sight T. The angle $\beta$ between the direction Sa of the carrier and the drilling direction $S_p$ can be read directly from the scale 12*a* because it is determined at the preceding hole on the basis of the angle $\gamma$. The feeding beam 5 can now be aligned by turning the boom 4 with respect to the carrier and by turning the feeding beam 5 with respect to the boom 4 by means of their own sensors and display devices so that the direction of the feeding beam 5 deviates from the longitudinal direction $S_a$ of the carrier la by the angle $\beta$, whereby by it is automatically substantially in parallel with the drilling direction $S_p$ and its inclination can be adjusted so that it is the same as that of the plane L. In this way, all holes drillable from the second drilling position of the carrier can again be drilled by turning the boom 4 and the feeding beam 5 in such a way that when the drill bit of the drill rod is positioned at the starting point of a hole, the feeding beam is inclined at the angle $\beta$ with respect to the longitudinal direction $S_a$ of the carrier 1*a* and at the same angle of inclination as the desired excavation plane L, and no other aligning measures are needed in this drilling position. The same procedure is repeated at the following holes, that is, the carrier la is driven to a suitable drilling position in which as many holes as possible can be drilled, and then the feeding beam is aligned at the first hole to be drilled in this drilling position as described above, and the rest of the holes can be drilled on the basis of the directional angle $\beta$ so measured. When the angle B between the drilling direction $S_p$ and the direction $S_a$ of the carrier is known, it is easy to turn the boom 4 and the feeding beam 5 by means of their normal directional scales or the display of the direction sensors in such a way that it deviates from the longitudinal direction $S_a$ of the carrier by the angle $\beta$ determined by means of the measuring device.

The method according to the invention is simple and easy to apply, as the measuring and alignment do not require any separate measuring devices and any exact fixed point which should absolutely be positioned in the drilling direction. The method of the invention can be applied simply by using, e.g., a simple combination of a sighting disc and an aligning disc, whereby no sensors or electrical connections need to be provided between the measuring device used as a sighting means and The other measuring means. The measuring device according to the invention is simple and easy to manufacture and realize and it is easy to use in connection with the drilling process. The method according to the invention is also easy to realize in a more automated manner, whereby e.g. the sighting device can be realized simply in electrical form by fixing the sight to the carrier by means of a sensor of some kind, such as a potentiometer or other similar sensor known per se in such a way that the sensor generates a signal corresponding to the angle of the sighting device. The sighting can thus be performed by first turning the sight into the drilling direction $S_p$, e.g., and then storing this value of the directional angle in the memory of a computer or a calculator by using a switch or a button or the like, whereafter the sight is turned towards the point of sight T, i.e. in the reference direction $S_t$, and the reference direction $S_t$ is similarly stored in the memory of the computer or calculator. The calculator or computer may thereby automatically calculate the angle $\gamma$ between the directions. As the drilling direction deviates from the direction $S_a$ of the carrier by the angle $\beta$, the calculator or computer can calculate the required inclination of the feeding beam with respect to its different shafts when the feeding beam 5 or the boom 4 is turned or displaced from one hole to another, and so the feeding beam is automatically positioned in the right direction when the drill bit of the drill rod is positioned at the starting point of the hole. At simplest, the calculator may calculate what the direction of the feeding beam and the boom should be when the drill bit is positioned at a certain point in order that the feeding beam and thus the drill rod would be positioned in the right direction, and the driller can thereby turn the feeding beam and the boom in a desired manner until it is appropriately positioned.

In the above description and the attached drawings the invention has been described and shown by way of example, and it is in no way restricted to this example. The measuring device may be a separately constructed device attached to the carrier in a manner known per se so that the measuring mark of the disc 13 always points in the direction $S_a$ of the carrier. The measuring device can, of course, also be effected in such a manner that the disc 13 is formed in the carrier or in a device attached to it, and the discs 11 and 12 are attached to it turnably. In place of the known locking nut structures for interconnecting the discs 11 and 12 and the discs 12 and 13, respectively, shown schematically in FIG. 2, it is possible to use any other known locking structure for momentarily preventing the discs from turning with respect to each other in a desired manner. The scale 12*a* can be formed in the body part 13 instead of the aligning disc 12, whereby the aligning disc 12 comprises a mark which indicates the measuring point and by means of which the turned angle $\beta$ can be seen. There may be provided e.g. two scales, one of which is positioned in the body part to indicate the angle $\beta$ between the carrier and the drilling direction and the other is positioned e.g. in the first disc or alternatively in the second disc and indicates thus the angle $\gamma$ between the reference direction and the drilling direction. The reference means may be mechanical scales and measuring means or scale discs or measuring lines used for measuring them. The reference means may also be measuring devices or indicators giving directly some of the directions to be measured or determined, or measuring devices or indicators indicating the angle between two given directions, whereby the device measures only the turning angle between two points indicated electrically or in some other way, or the corresponding directions. Even though it is shown in the figures and stated in the description that the fixed point T used as an aligning mark is positioned in the drilling plane in front of the device, it may equally well be positioned at the same side with respect to the drilling plane as the device, whereby the sighting device can be used by looking through it the other way round or e.g. by using two reversely symmetrical scales. When applying this method, the error is naturally minimized when the fixed point used as the point of sight is substantially in the direction of the drilling plane at its either end, because the displacement of the device in the drilling plane thereby does not actually cause an angle error, the displacing movement being parallel to the reference direction $S_t$. In such cases, the measuring point can be a sighting target or a point of sight positioned rather close to the drilling plane and the holes to be drilled without any major angle error. Preferably, the point of sight deviates less than 45° from the direction of the excavation plane. In principle, a point of the compass may be used as the reference direction, whereby the measuring device has to comprise a sensor for detecting the angle between the point of the compass and the sight of the measuring device. This angle is thereby the angle $\gamma$ defined between the reference direction, i.e. the point of the compass, and the sighting direction, or, more simply, the drilling direction, and the rest can be effected as described in the text above. In principle, the method causes a small directional error when the reference direction $S_t$ deviates from the direction of the excavation plane L as the line of sight turns about the point of sight when the equipment is displaced placed in the direction of the drilling plane; in practice, however, this error is negligible in view of the drilling process and considering the considerable advantages obtained by the use of the equipment.

We claim:

1. A method for aligning a feeding beam attached to the end of a boom turnable with respect to a carrier of rock drilling equipment, the feeding beam being turnable with respect to the boom when drilling holes in rock surfaces of the earth substantially in line and in the same plane comprising the steps of:

determining a first angle between a longitudinal direction $S_a$ of the rock drilling equipment and a drilling direction $S_p$;

aligning the feeding beam with the drilling direction $S_p$ in parallel with said plane by turning the boom with respect to the carrier and the feeding beam with respect to the end of the boom such that turning angles of said feeding beam with respect to said boom are determined on the basis of a second angle between the boom and the longitudinal direction $S_a$ of the carrier and the first angle between the longitudinal direction $S_a$ of said carrier and the drilling direction $S_p$;

determining a reference direction $S_t$ independent of a magnetic field for each drilling position of the carrier;

determining a third angle between the reference direction $S_t$ and the drilling direction $S_p$;

determining the drilling direction $S_p$ at least after the first drilling position of the drilling equipment on the basis of the reference direction $S_t$ and the third angle;

determining the first angle between the longitudinal direction $S_a$ of said carrier and the drilling direction $S_p$ on the basis of the determined drilling direction $S_p$; and aligning the feeding beam on the basis of the determined first angle so that it is parallel with the drilling direction $S_p$ and the drilling plane.

2. A method according to claim 1 including determining the reference direction $S_t$ by sighting a fixed point immovable at least during the drilling process and positioned at a distance from the drilling plane as a point of sight T.

3. A method according to claim 1 wherein the reference direction $S_t$ deviates no more than 45° from the direction of the drilling plane.

4. A method according to claim 1 including determining the reference direction by means of a measuring device attached to the carrier of the rock drilling equipment and turning the measuring device in the first drilling position $PA_1$ of the rock drilling equipment alternately in the drilling direction $S_p$ and in the reference direction $S_t$, and determining the third angle between the directions as a difference between said directions $S_p$, $S_t$.

5. Rock drilling apparatus comprising:

a carrier;

a boom pivotally carried by said carrier;

a feeding beam mounted turnably in two planes at an angle with respect to each other with respect to the boom;

control means for turning said boom and said feeding beam;

measuring means for measuring an angle $\alpha$ between a longitudinal direction $S_a$ of said carrier 1*a* and said boom for measuring the direction of said feeding beam with respect to said boom and for measuring an angle $\beta$ between the longitudinal direction $S_a$ of said carrier and a drilling direction $S_p$;

calculating means for calculating set values for aligning said feeding beam on the basis of said measured angles $\alpha$, $\beta$;

an indicating means for indicating an angle between a reference direction $S_t$ and said drilling direction $S_p$, said calculating means being arranged to calculate the set values for the feeding beam on the basis of the indicated angle.

6. Rock drilling apparatus according to claim 5 wherein said indicating means includes a measuring device carried by said carrier and turnable both in the drilling direction $S_p$ and in the reference direction $S_t$ to determine the angle between them.

7. Rock drilling apparatus according to claim 6 wherein said measuring device is connected to said calculating means so that the calculating means calculates the set values for said feeding beam directly on the basis of the indicated angle value after the determination of said angle.

8. Rock drilling apparatus according to claim 7 wherein said control means are connected to automatically align said feeding beam in accordance with the set values calculated by said calculating means.

9. A measuring device for aligning a feeding beam in rock drilling equipment comprising:

a body part positioned at least in a longitudinal direction $S_a$ of a carrier of the rock drilling equipment;

an aligning means rotatable with respect to said body part, said aligning means being arranged to be positioned in a drilling direction $S_p$ for determining an angle $\beta$ between the longitudinal direction $S_a$ of the carrier and the drilling direction $S_p$; and reference means for defining a reference direction $S_t$ and for determining an angle between said reference direction $S_t$ and the drilling direction $S_p$.

10. A measuring device according to claim 9 wherein said reference means comprises sighting means arranged to be directed towards a fixed point positioned at a distance from a drilling plane L and used as a point of sight T for defining the reference direction $S_t$ from the measuring device to the point of sight T, and an indicator for determining an angle between said sighting means and said aligning means.

11. A measuring device according to claim 9 wherein said aligning means is alternatively rotatable in the drilling direction $S_p$ and in the reference direction $S_t$, and an indicator for indicating alternately the angle $\beta$ between the longitudinal direction $S_a$ of said carrier and the drilling direction $S_p$ and the angle between the drilling direction $S_p$ and the reference direction $S_t$.

12. A measuring device according to claim 10 wherein said sighting means and said aligning means comprise discs mounted for coaxial rotation about a shaft with respect to said carrier of the drilling equipment, a locking means for locking said sighting disc and said aligning disc to one another to define the angle between the reference direction $S_t$ and the drilling direction $S_p$ when said sighting disc is directed towards the fixed point serving as the pint of sight T and said aligning disc is directed in the drilling direction $S_p$, and an angle scale for indicating the angle $\beta$ between the drilling direction $S_p$ and the longitudinal direction $S_a$ of said carrier when said sighting disc is directed towards said fixed point serving as the point of sight T and said discs are locked to one another by said locking means.

13. A measuring device according to claim 9 wherein said measuring device is connected to a calculating means for calculating the angle $\beta$ and the angle between the reference direction $S_t$ and the drilling direction $S_p$ on the basis of the determined directions and calculates set values for said feeding beam on the basis of them.

* * * * *

UNITED STATES PATENT AND TRADEMARK OFFICE

CERTIFICATE OF CORRECTION

PATENT NO. : 5,348,105
DATED : September 20, 1994
INVENTOR(S) : Juhani Lappalainen, et al.

It is certified that error appears in the above-indentified patent and that said Letters Patent is hereby corrected as shown below:

On the title page, item [30], should read--PCT/F191/00358, filed November 27, 1991 under "Foreign Application Priority Data"--.

Signed and Sealed this

Sixteenth Day of July, 1996

Bruce Lehman

*Attest:*

BRUCE LEHMAN

*Attesting Officer*

*Commissioner of Patents and Trademarks*